US008845151B1

(12) United States Patent
Hale

(10) Patent No.: US 8,845,151 B1
(45) Date of Patent: Sep. 30, 2014

(54) LIGHT FOR BASKETBALL GOAL

(76) Inventor: Roger Hale, Chillicothe, TX (US)

( * ) Notice: Subject to any disclaimer, the term of this patent is extended or adjusted under 35 U.S.C. 154(b) by 291 days.

(21) Appl. No.: 13/226,098

(22) Filed: Sep. 6, 2011

(51) Int. Cl.

| | |
|---|---|
| ***F21V 1/00*** | (2006.01) |
| ***F21S 8/00*** | (2006.01) |
| ***E04H 12/00*** | (2006.01) |
| ***A63B 63/08*** | (2006.01) |

(52) U.S. Cl.
CPC ..... *A63B 63/083* (2013.01); *A63B 2207/02* (2013.01)
USPC ..... 362/431; 362/235; 52/40

(58) Field of Classification Search
CPC .. A63B 63/083; A63B 2207/02; A63B 43/06; F21V 33/008
USPC ..... 362/253, 431; 52/40
See application file for complete search history.

(56) References Cited

U.S. PATENT DOCUMENTS

| | | | | |
|---|---|---|---|---|
| 4,492,049 | A | 1/1985 | Gaylor | |
| 5,124,899 | A * | 6/1992 | Hale | 362/253 |
| 5,677,896 | A | 10/1997 | Nunes | |
| 7,244,046 | B2 * | 7/2007 | Webb | 362/253 |
| 7,462,117 | B2 * | 12/2008 | White et al. | 473/481 |
| 7,666,109 | B2 * | 2/2010 | White | 473/483 |
| 2006/0291221 | A1 | 12/2006 | Webb | |
| 2007/0297165 | A1 | 12/2007 | Watson et al. | |
| 2008/0004139 | A1 | 1/2008 | Jang | |
| 2009/0190365 | A1 | 7/2009 | Kauffman | |

OTHER PUBLICATIONS

Sales brochure by Escalade Sports, B1031, "Goalrilla: The Toughest System on the Planet", date unknown.

* cited by examiner

*Primary Examiner* — David J Makiya
(74) *Attorney, Agent, or Firm* — James E. Walton; Richard G. Eldredge

(57) ABSTRACT

A basketball system having a basketball goal and a lighting system such that light is provided for the playing of basketball or other activities at night. The lighting system has a lighting apparatus and a pole with a vertical shaft and an arm. The lighting system is configured to couple to an existing basketball goal or be installed remote to the basketball goal. The lighting apparatus is configured to be lowered near to the ground by rotating the lighting system such that servicing may be done to the lighting apparatus without the use of a ladder.

20 Claims, 15 Drawing Sheets

LIGHT FOR BASKETBALL GOAL

BACKGROUND

1. Field of the Invention

The present application relates generally to a light pole and, more particularly, to a light pole for a basketball goal.

2. Description of Related Art

Basketball goals have been around for many years. Basketball goals are commonly found outside typically mounted to a wall of a structure or more commonly on the ground through the use of a post. The post is typically secured in the ground with concrete or stabilized by a ballast container to permit mobility of the basketball goal. When used at night, it can be difficult to sufficiently light the basketball goal without causing interference with the vision of the players while providing adequate light to play. In order to overcome these problems, lighting fixtures have been attached to the post of the basketball goal as seen in U.S. Pat. No. 5,124,899.

Referring now to FIG. 1, a typical basketball goal 13 having a lighting system 11 is illustrated. Basketball goal 13 is generally composed of a backboard 15 having a rim 17. Backboard 15 is typically connected to a post 25 used for securing or stabilizing basketball goal 13 to the ground. Poles 31 are coupled to post 25 behind backboard 13. A lighting fixture 29 having wires 35 routed inside poles 31 is suspended above the basketball goal 13.

Typically, current configurations of lighting systems can result in difficulty servicing the light fixture, requiring the use of a tall ladder or removal of the system from the post. Furthermore, installation of the lighting system can typically require multiple people and relatively great effort in lifting the lighting system into place on the post. Additionally, sudden vibrations or jolting of backboard 15 can be transmitted to the lighting fixture possibly causing premature wear of the lighting fixture.

Although great strides have been made in basketball lighting, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
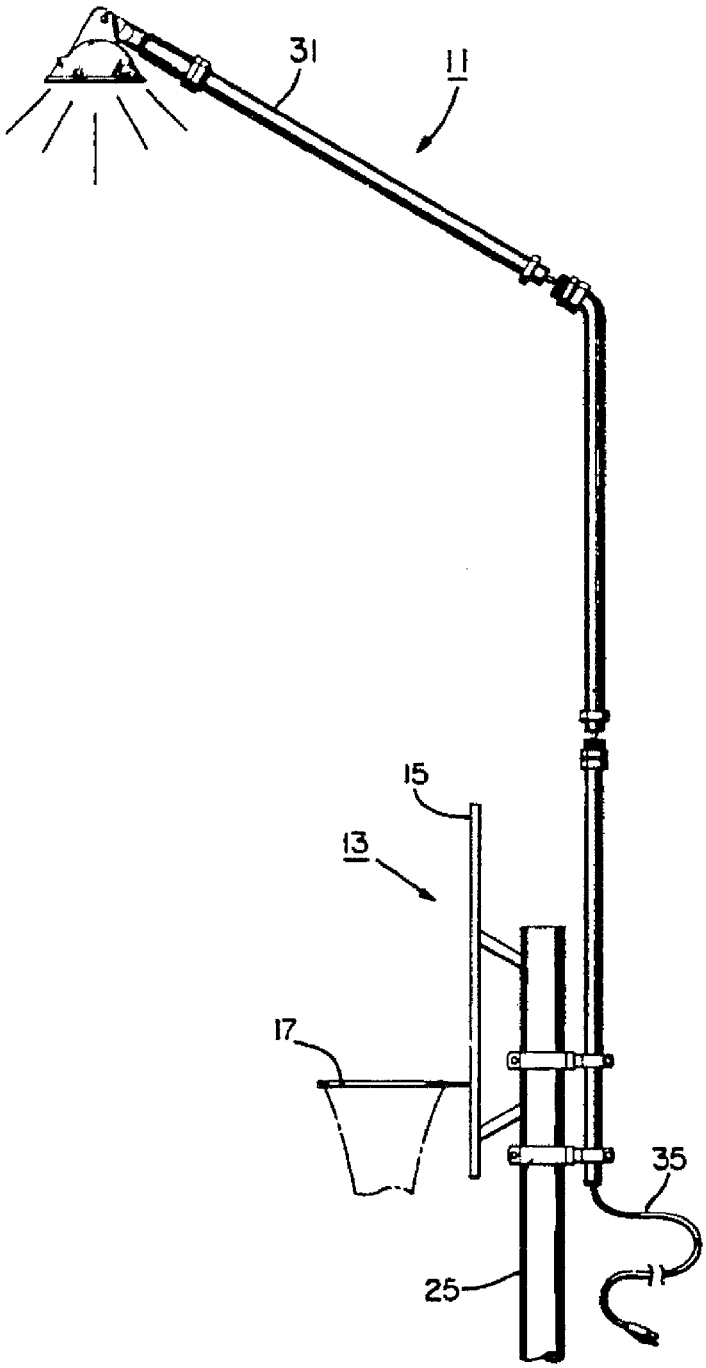
FIG. 1 (Prior Art)
FIG. 1 is a side view of a conventional lighting system for a basketball goal.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 2:
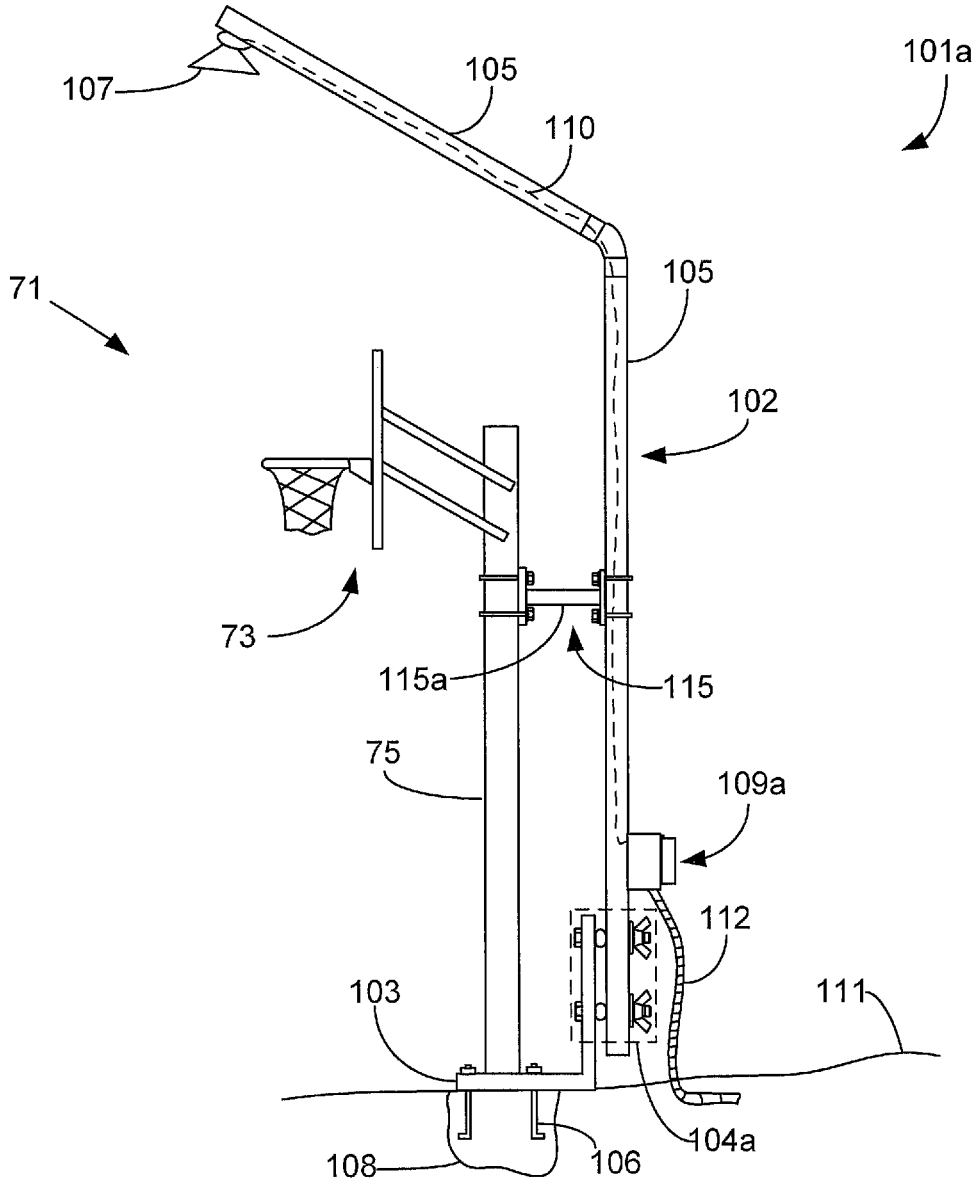
FIG. 2 is a side view of a lighted basketball system according to the preferred embodiment of the present application.

Referring now to FIG. 2 in the drawings, a basketball system 101*a* according to the preferred embodiment of the present application is illustrated. Basketball system 101*a* includes a basketball goal 71 having a hoop portion 73 and a post 75, a lighting system 102, a base system 103, a fastening system 104*a*, and a power center 109*a*. In the preferred embodiment, base system 103 is rigidly coupled to a bottom portion of post 75. Base system 103 serves to support both basketball goal 71 and lighting system 102. Lighting system 102 is coupled to base system 103 by fastening system 104*a*. Base system 103 supports basketball goal 71 in a relatively upright position.

Lighting system 102 consists of a pole 105 and a lighting apparatus 107. Wires 110 from lighting apparatus 107 extend within pole 105 to power center 109*a*. Power center 109*a* receives power from a power source, such as a house, through a conduit 112. Power center 109*a* is preferably located on pole 105 and is used to operate and control basketball system 101. Details concerning power center 109*a* will be discussed later on. As needed, optional support may be provided by using a support system 115 releasably coupling pole 105 and basketball goal 71. Although FIG. 2 illustrates the use of support system 115, it is understood that support system 115 is optional, thereby permitting basketball system 101*a* to be used without support system 115.

Figure 3:
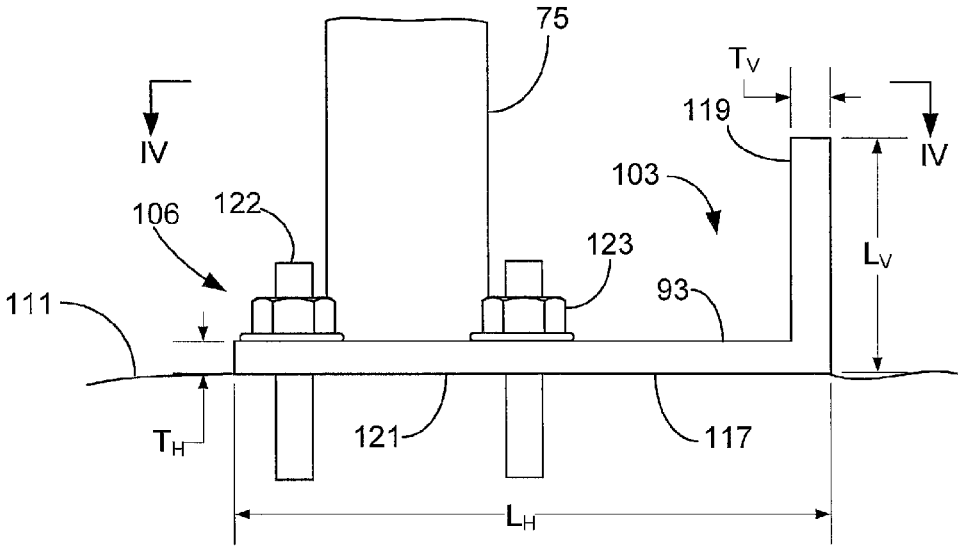
FIG. 3 is an enlarged side view of a base system of FIG. 2.
Figure 4:
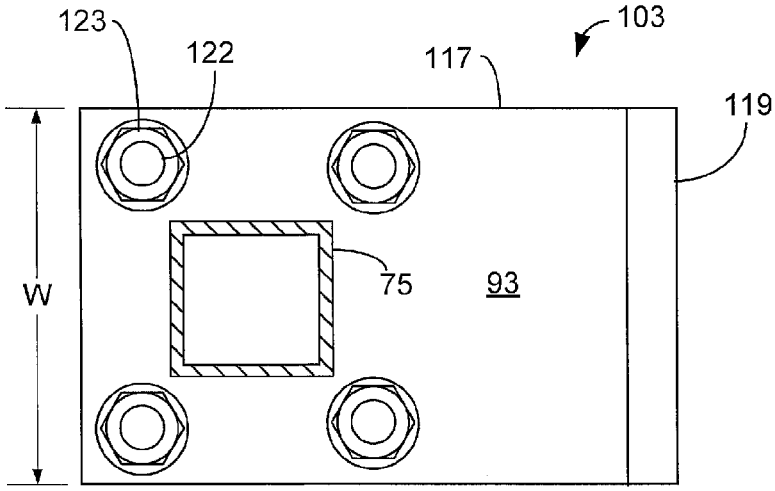
FIG. 4 is a top section view of the base system of FIG. 3 taken at IV-IV.

Referring now also to FIGS. 3 and 4 in the drawings, side and top views respectively, of base system 103 are illustrated. In the preferred embodiment, base system 103 is composed of member 93. Member 93 is a rigidly formed piece of material, such as steel, having a horizontal portion 117 and a vertical portion 119. Vertical portion 119 and horizontal portion 117 are preferably formed from the same piece of material. However, it is understood that base system 103 is not so limited. In other embodiments, member 93 may be formed by joining two pieces of material to create horizontal portion 117 and vertical portion 119. For example, other embodiments may use welding or external bracketry to join and stabilize horizontal portion 117 and vertical portion 119 with respect to one another.

Base system 103 is used to support basketball goal 71 and lighting system 102. Both basketball goal 71 and lighting system 102 cantilever off base system 103 thereby requiring base system 103 to be rigid and strong. Member 93 is depicted in the drawings as having a uniform size and shape. Member 93 has a width W, a horizontal thickness $T_H$, and a vertical thickness $T_V$. Furthermore, member 93 has a horizontal length $L_H$ and a vertical length $L_V$. It is appreciated that thicknesses $T_H$, $T_V$ and lengths $L_H$, $L_V$ may be any value. In addition, other embodiments may permit thicknesses $T_H$, $T_V$ to vary along the length $L_H$, $L_V$ and width W, thereby creating a non-uniform size and shape. Whether uniform or non-uniform, member 93 is designed to support basketball goal 71 and lighting system 102. It should be appreciated that base system 103 may incorporate other features to facilitate additional strength, such as stiffeners or ribs.

Member 93 has a bottom surface 121 that is in contact with surface 111. Surface 111 may be any surface, such as: wood, concrete, or dirt, to name a few. Member 93 is coupled to surface 111 with base fasteners 106. Base fasteners 106 typically include a threaded rod 122 protruding through surface 111 and apertures (not shown) in member 93, as well as a plate fastener 123. Plate fasteners 123, such as nuts and washers are used to threadedly operate with threaded rods 122 and secure member 93 by interference fit to surface 111. Although shown having four threaded rods 122 in the preferred embodiment, it is understood that one or more threaded rods 122 and plate fasteners 123 may be used to secure member 93. Furthermore, it is understood that other methods of securing member 93 to surface 111 may be employed, such as screws or concrete formed around a portion of member 93.

Figure 5:
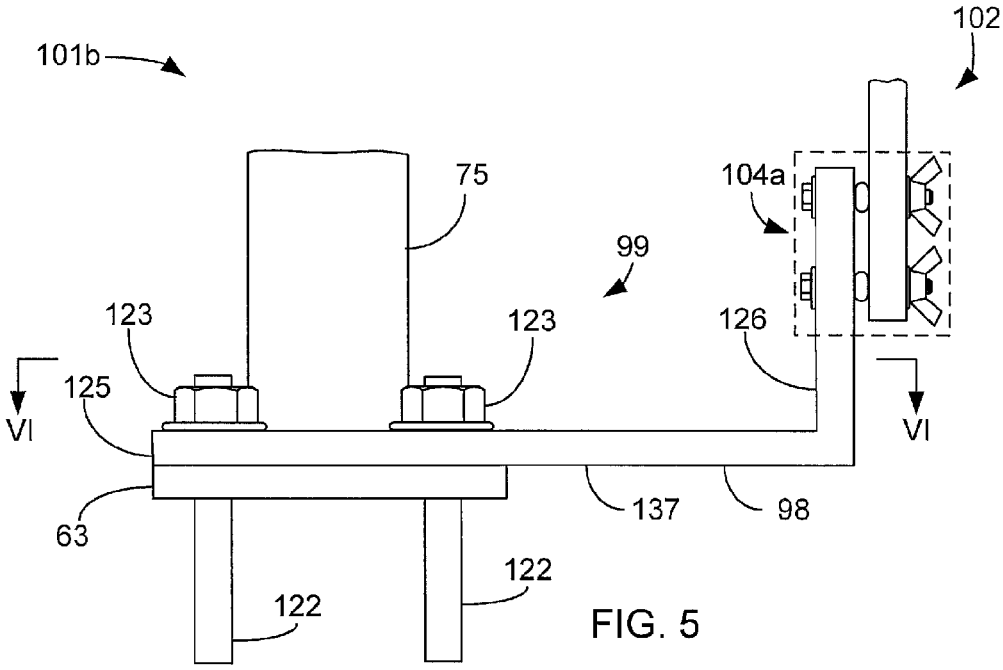
FIG. 5 is an enlarged side view of an alternate embodiment of the base system of FIG. 2 as used with a base plate.
Figure 6:
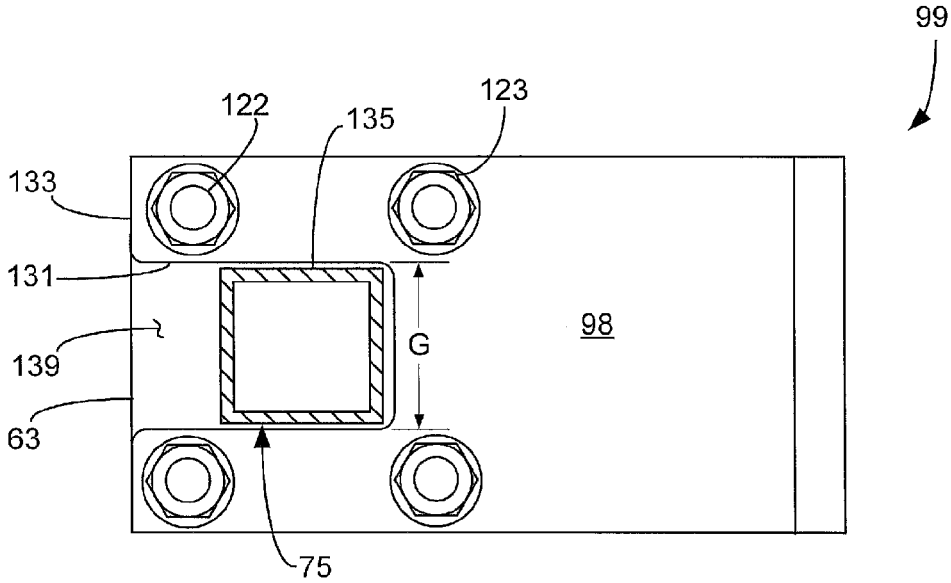
FIG. 6 is a top section view of the base system of FIG. 5 taken at VI-VI.

Referring now also to FIGS. 5 and 6 in the drawings, a side and top view respectively, of an alternate embodiment of base system 103 as seen in FIGS. 2-4. In instances where basketball goal 71 is installed prior to use with lighting system 102, typically a base plate 63 is used in place of base system 103 to secure basketball goal 71 to surface 111. In such instances, a base system 99 is used in place of base system 103. In the alternate embodiment, basketball system 101*b* includes lighting system 102, power center 109*a*, fastener system 104*a*, and base system 99 for use in conjunction with basketball goal 71.

Base system 99 incorporates all the same functions and features of base system 103 except as described herein. Base system 99 is composed of member 98. Member 98 has a horizontal portion 125 and a vertical portion 126. Member 98 is removable from post 75 in this embodiment. Member 98 rests on base plate 63 and surrounds post 75 on three sides. Member 98 is configured to have apertures (not shown) for acceptance of threaded rods 122. Member 98 has a slot 131 positioned at an end 133 and sized slightly larger in width, width G, than post 75. Slot 131 permits member 98 to surround post 75 on three sides 135 and position the apertures over threaded rods 122 such that member 98 can be lowered into contact with base plate 63. Member 98 is then coupled to base plate 63 using existing plate fasteners 123.

The method of installing base system 99 uses the following steps. Post 75 is first supported with external supports so as to retain the vertical alignment. The existing plate fasteners 123 are removed from threaded rods 122. Member 98 is positioned around post 75 and over base plate 63 such that apertures (not shown) in member 98 align with threaded rods 122. Member 98 is then lowered onto base plate 63 such that a bottom surface 137 of member 98 contacts a top surface 139 of base plate 63. Existing plate fasteners 123 are then threadedly reattached and secured by interference fit above member 98.

An advantage of the present embodiment is that lighting system 102 and base system 99 are removable from basketball goal 71. Furthermore, base system 99 uses base fasteners 106. Although described and depicted as having four apertures for use on all four threaded rods 122, it is understood that member 98 may have any number of apertures and operate on any number of threaded rods 122. For example, member 98 may use only two threaded rods 122 for coupling member 98 to base plate 63. Furthermore, member 98 may surround post 75 on any number of sides therein incorporating slot 131 of any size. For example, member 98 may use two threaded rods 122 and thereby not incorporate slot 131.

Figure 7:
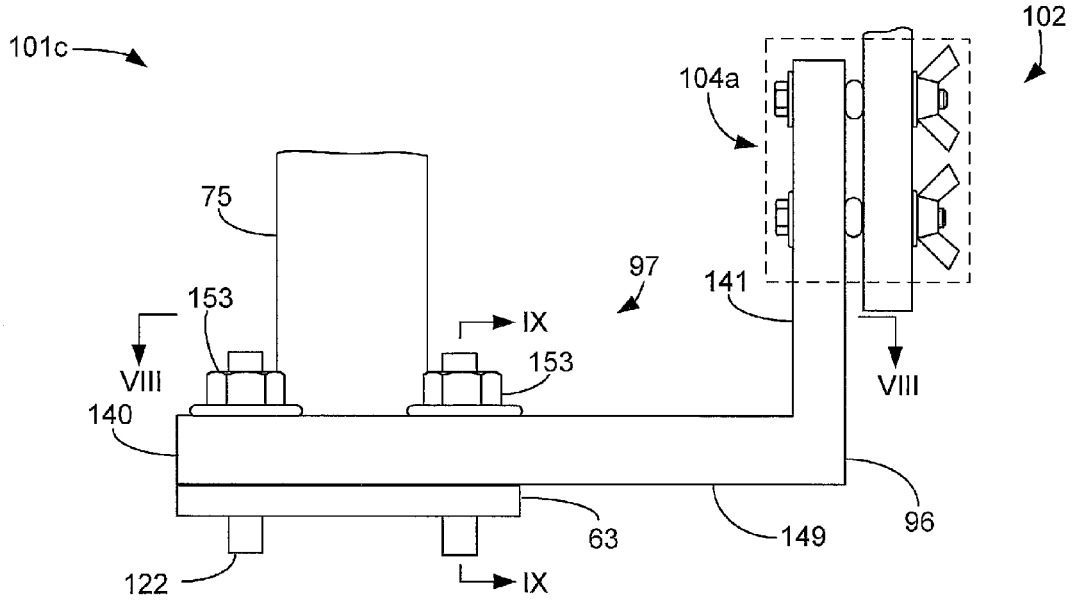
FIG. 7 is an enlarged side view of an alternate embodiment of the base system of FIG. 2 as used with the base plate.
Figure 8:
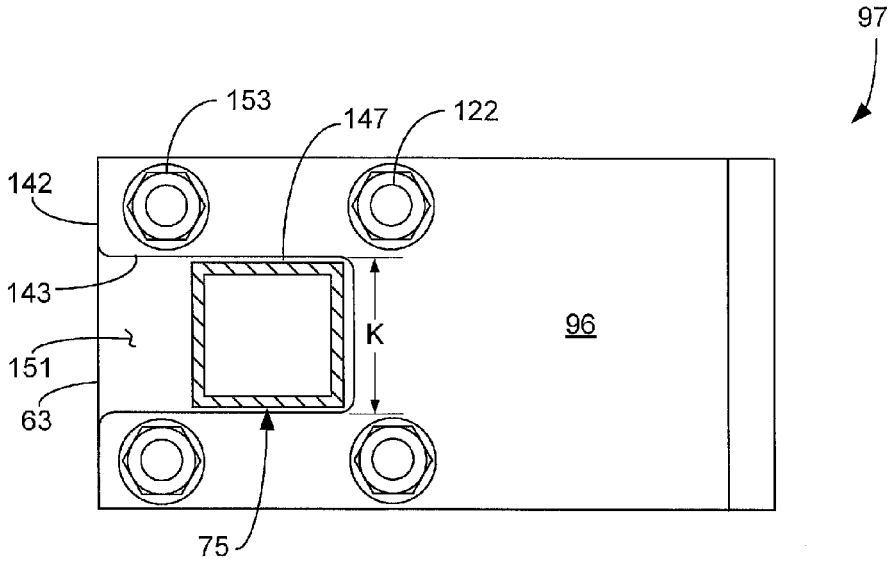
FIG. 8 is a top section view of the base system of FIG. 7 taken at VIII-VIII.
Figure 9:
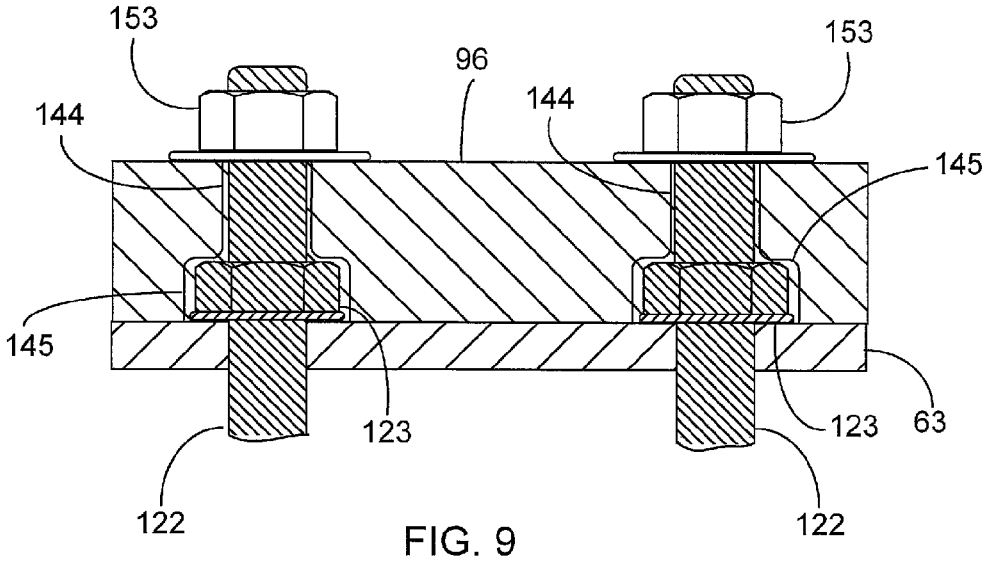
FIG. 9 is a partial section view of the base system of FIG. 7 taken at IX-IX.

Referring now also to FIGS. 7, 8, and 9 in the drawings, side, top, and section views, respectively, of an alternate embodiment of base system 103 is illustrated. Since plate fasteners 123 need to be removed from basketball goal 71 and then refastened for use with base system 99, basketball goal 71 typically needs to be supported. In such an embodiment, it can become difficult and possibly unsafe to remove plate fasteners 123 without removing hoop portion 73 as well. In this embodiment, basketball system 101*c* includes lighting system 102, fastener system 104*a*, power center 109*a*, and base system 97 for use in conjunction with basketball goal 71. Existing plate fasteners 123 are permitted to remain threadedly fastened while base system 97 is installed.

Base system 97 incorporates all the same functions and features of base system 103 except as described herein. Base system 97 includes a member 96 and a base system fastener 153. Base system 97 is removable from post 75. Member 96 has a horizontal portion 140 and a vertical portion 141. Member 96 rests on base plate 63 and surrounds post 75 on three sides. Member 96 is configured to have an aperture 144 for acceptance of threaded rod 122 and a bore 145 for acceptance of plate fastener 123. Member 96 has a slot 143 positioned at an end 142 and sized slightly larger in width, width K, than post 75. Slot 143 permits member 96 to surround post 75 on three sides 147 and be positioned such that member 96 can be lowered into contact with base plate 63. Member 96 is then coupled to base plate 63 using base system fasteners 153. As seen in FIG. 9, apertures 144 are aligned for acceptance of threaded rods 122. Bores 145 are sized sufficiently to surround plate fasteners 123 and concentrically align with apertures 144.

The method of installing base system 97 uses the following steps. Member 96 is positioned around post 75 and over base plate 63 such that apertures 144 align with threaded rods 122 and bores 145 align with plate fastener 123. Member 96 is then lowered onto base plate 63 such that a bottom surface 149 of member 96 contacts a top surface 151 of base plate 63. Base system fasteners 153 are then threadedly attached to threaded rods 122 and secured by interference fit.

One advantage of base system 97 is that post 75 does not need to be supported while installing base system 97 because existing plate fasteners 123 are not removed. A further advantage of the present embodiment is that lighting system 102 and base system 97 are removable. The removable feature allows a user to add or remove lighting system 102 without interfering with existing plate fasteners 123.

Although described and depicted as having four apertures for use on all four threaded rods 122, it is understood that member 96 may have any number of apertures 144 and/or bores 145 and operate on any number of threaded rods 122. For example, member 96 may use only two threaded rods 122 for coupling member 96 to base plate 63. Furthermore, member 96 may surround post 75 on any number of sides therein incorporating slot 143 of any size. For example, member 96 may use two threaded rods 122 and thereby not incorporate slot 143. In addition, bores 145 and aperture 144 may be any size. For example, bore 145 and aperture 144 may be the same size.

Figure 10:
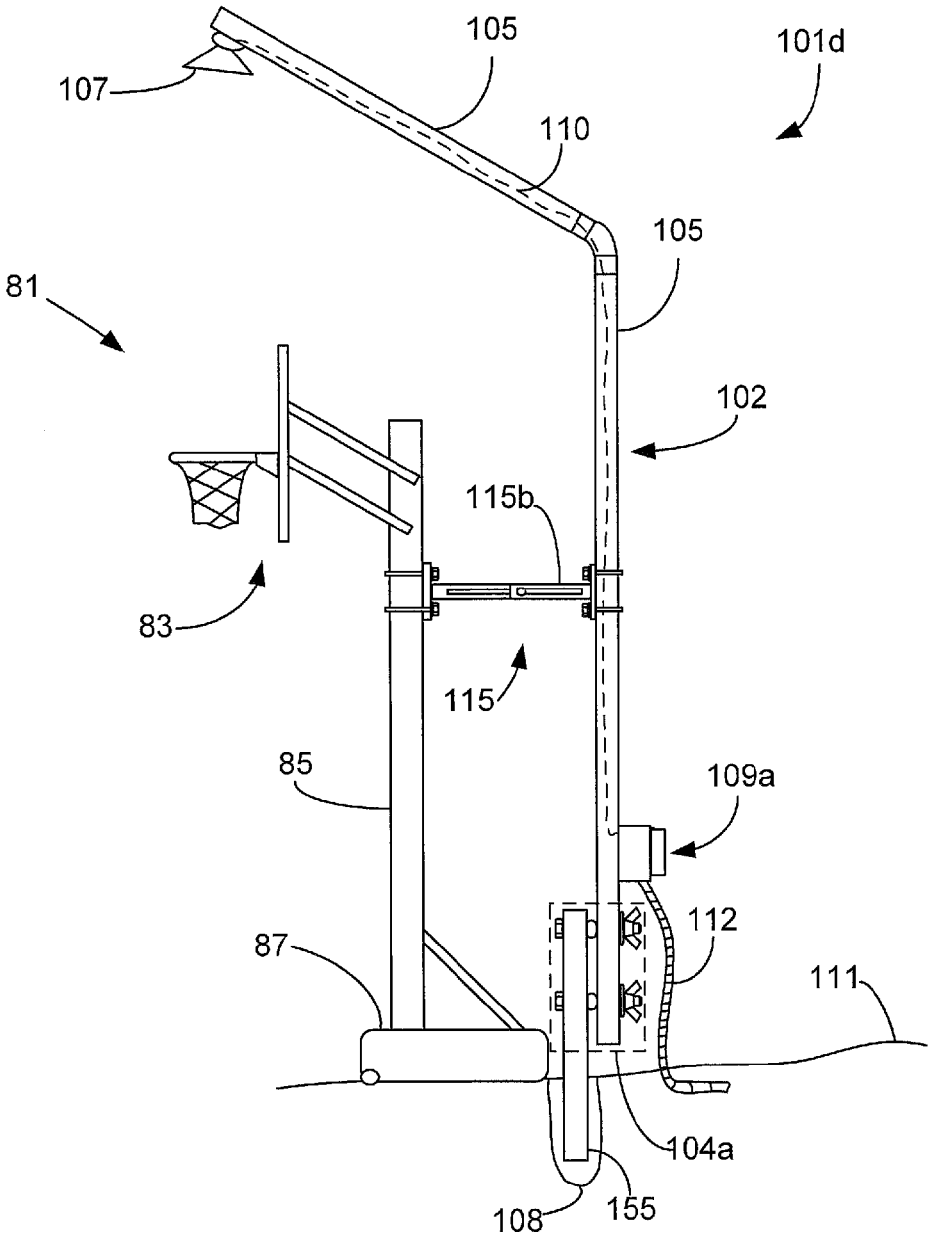
FIG. 10 is a side view of an alternate embodiment of the base system of FIG. 2.

Referring now also to FIG. 10 in the drawings, an alternate embodiment of base system 103 is illustrated. Previous discussion has centered on attaching lighting system 102 to basketball goal 71. Selected styles of basketball goals do not provide means of supporting base system 103 or alternate embodiments. As such, an alternate embodiment of base system 103 provides for the supporting of lighting system 102 independent of basketball goal 71. Basketball system 101*d* is composed of lighting system 102, a base system 155, power center 109*a*, and fastening system 104*a*. A basketball goal 81 is a portable basketball goal having a hoop portion 83, a post 85, and a base ballast 87. Although described herein as basketball system 101*d* for use with basketball goal 81, it is understood that basketball system 101*d* may be used similarly with basketball goal 71.

Base system 155 is typically a metallic bar, such as steel, similar in size to that of pole 105 in lighting system 102. Base system 155 can be hollow or have a full cross-section, wherein base system 155 is solid throughout the cross-section. Base system 155 may be secured to surface 111 by any number of means known to a person of ordinary skill in the art, such as using concrete 108. Likewise, base system 155 may be secured to surface 111 in a manner similar to that of base system 103 by using bolts and fasteners, for example. Furthermore, base system 155 can extend above surface 111 any distance for fastening lighting system 102. For example, base system 155 can be flush with surface 111 or extend above surface 111.

Base system 155 uses fastening system 104*a* to secure lighting system 102. Base system 155 has the advantage of locating lighting system 102 independent of basketball goal 81, 71, thereby permitting the user the flexibility to locate lighting system 102 in any location with respect to basketball goal 81, 71. Additionally, it should be understood that base systems 99, 97, 155 are located independent of post 75, 85. As such, base systems 99, 97, 155 do not attach or secure to post 75, 85

Figure 11:
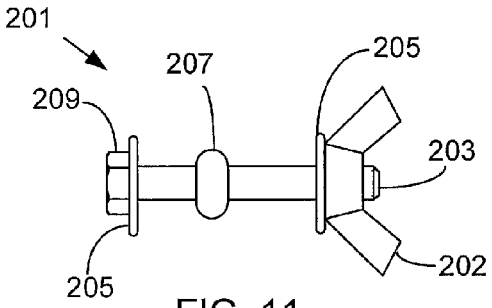
FIG. 11 an enlarged side view a pole fastener used in a fastening system of FIG. 2.
Figure 13A:
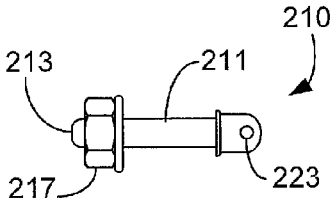
FIGS. 13A and 13B are enlarged side and top views, respectively, of an alternate embodiment of the pole fastener of FIG. 11.
Figure 13B:
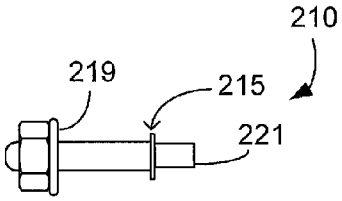
Figure 12:
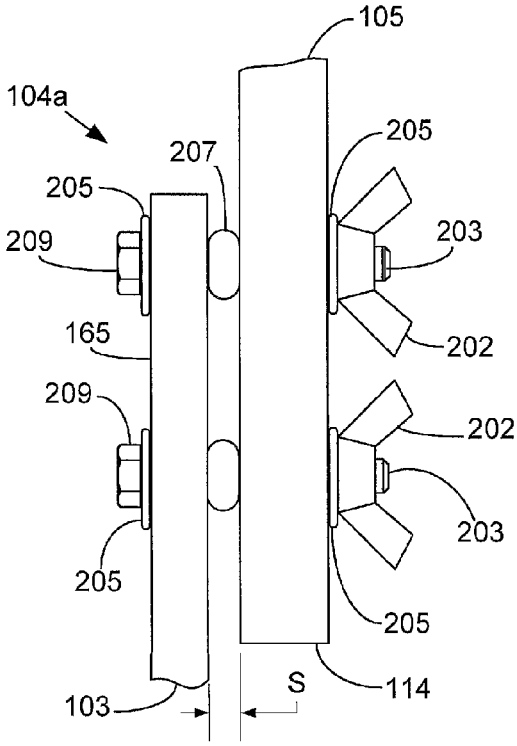
FIG. 12 is an enlarged side view of the fastening system of FIG. 2 using the pole fasteners of FIG. 11.

Referring now also to FIGS. 11 and 12 in the drawings, enlarged side views of fastening system 104*a* and a pole fastener as seen in FIG. 2 is illustrated. Fastening system 104*a* pivotally couples lighting system 102 with base system 103, 99, 97, 155. The method of attaching lighting system 102 and particularly pole 105, to base system 103 is similar to that of the alternate embodiments of base systems 99, 97, 155. Therefore, hereinafter, use of base system 103 will be inferred to also incorporate base systems 99, 97, 155 unless otherwise stipulated. Furthermore, although fastening system 104*a* is described with pole fasteners, it is understood that fastening system 104*a* can incorporate the use of various types of pole fasteners beyond that described herein.

In the preferred embodiment, pole 105 is coupled to base system 103 by using one or more pole fasteners. Pole fasteners are configured to permit lighting system 102 to rotate or pivot in a variety of directions so as to allow lighting apparatus 107 to be lowered near to the ground or surface 111. The ability to lower lighting apparatus 107 allows a user to more easily and safely service lighting apparatus 107 without the need to use a ladder. Additionally, the location of the pole fasteners, being relatively near surface 111, permits a user to install and secure lighting system 102 to basketball goal 71, 81 without the need to use a ladder. Basketball system 101*a*, 101*b*, 101*c*, 101*d* can be assembled and installed while remaining on surface 111.

Pole fasteners come in a number of embodiments. It is preferred that the pole fasteners are configured to allow for quick-release removal. The ability to be quick-release pole fasteners allows a user to loosen and remove selected pole fasteners without the need of additional tools. It is understood that other embodiments exist and are incorporated herein that permit rotation of pole 105 sufficiently to allow lighting apparatus 107 to lower for servicing and installation without the use of a ladder or other body raising equipment.

As seen in FIGS. 11 and 12, a bolt fastener 201 is shown. Bolt fastener 201 is a type of pole fastener used in fastening system 104*a*. Bolt fastener 201 includes a wing nut 202, a bolt 203, a washer 205, and a bushing 207. Bolt 203 slides through concentrically aligned apertures in base system 103 and pole 105. The weight of lighting system 102 predominantly rests on bolts 203. Bushing 207 is inserted between pole 105 and base system 103 such that a desired spacing S is retained between pole 105 and base system 103 and also to permit relatively smooth rotation of pole 105. Bushing 207 can vary in size to create a larger surface area in contact with base system 103 and/or pole 105, or to create larger or smaller spacing S between base system 103 and pole 105. Wing nut 202 is threadedly coupled to bolt 203 and secured by interference fit. Washers 205 are used between a head 209 of bolt 203 and base system 103, and between wing nut 202 and pole 105. Wing nuts 202 can be any size. Preferably wing nuts 202 are enlarged to permit easy tightening and removal without the need of tools.

In the preferred embodiment, at least two bolt fasteners 201 are used as seen in FIG. 12. Bolt fasteners 201 are aligned relatively vertically along pole 105 so as to be approximately aligned with post 75, 85. The spacing between bolt fasteners 201 can be any distance. Furthermore, bolt fasteners 201 can be located any height above surface 111.

In order to install fastening system 104*a* with bolt fasteners 201, the following steps should be taken. After base system 103 is installed and secured, raise an end 114 of pole 105 so as to align the apertures (not shown) in pole 105 and base system 103. Insert washer 209 on bolt 203 and slide bolt 203 through base system 103. Align bushing 207 with bolt 203 and continue to slide bolt 203 through bushing 207 and pole 105. Slide washer 205 over bolt 203 and position washer 205 against pole 105. Threadedly secure wing nut 202 loosely on bolt 203. Pivot pole 105 around bolt 203 such that the other apertures are aligned. Follow the process described above for installation of the other bolt fasteners 201. When both bolt fasteners 201 are installed, tighten wing nuts 202 and secure by interference fit. When wing nuts 202 are tightened by interference fit on pole 105, pole 105 is securely fastened so as to resist rotation in a plane parallel to a face 165 of base system 103.

To lower lighting apparatus 107 to the ground, a single bolt fastener 201 is removed while the other bolt fastener 201 is loosened by rotating wing nut 202. In doing so, pole 105 is able to pivot on the remaining bolt fastener 201 in any direction in the plane parallel to face 165.

Although washer 205 is used twice, it is understood that washer 205 used adjacent base system 103 and washer 205 used adjacent pole 105 may be sized differently. Furthermore, it is understood that any number of bolt fasteners 201 may be used. Additionally, although washer 205 is described as being separate from bolt 203 and wing nut 202, it is understood that either washer 205 may be incorporated into bolt 203 or wing nut 202.

Figure 15:
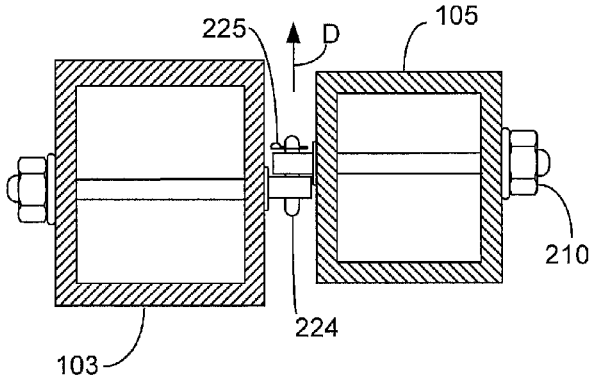
FIG. 15 is an enlarged section view of the pole fasteners of FIG. 14 taken at XV-XV.

Referring now also to FIGS. 13A, 13B, 14, and 15 in the drawings, side and top views of an alternate embodiment of bolt fastener 201 is illustrated. Pin fastener 210 is also a pole fastener and an alternate embodiment of bolt fastener 201. Pin fastener 210 includes a threaded shaft 211 having a first end 213 and a second end 215, a nut 217, a washer 219, a disk 221, and a disk aperture 223. Disk 221 is rigidly coupled to second end 215 of threaded shaft 211. Disk 221 has a disk aperture for insertion of a disk pin 224. Nut 217 and washer 219 are threadedly coupled to first end 213 of threaded shaft 211. Nut 217 is tightened around and secured on threaded shaft 211 by interference fit. The configuration of pin fastener 210 generally requires the use of separate pin fasteners 210 located in pole 105 and base system 103 as seen in FIG. 15. Because of this configuration typically only one disk pin 224 is used and/or provided for each set of two pin fasteners 210. Disk pin 224 is inserted into concentrically aligned disk apertures 223 in both pin fasteners 210 as seen in FIG. 15. It is understood that shaft 211 can be lengthened or shortened so as to fit various thicknesses of base system 103 and pole 105. In this embodiment, the pole pivots around disk pin 224.

Pin fasteners 210 are similar in form and function to bolt fasteners 201, having the same features and limitations except as noted herein. In order to install fastening system 104*a* with pin fasteners 210, the following steps should be taken. Before raising pole 105 and aligning the apertures (not shown) in pole 105 and base system 103, pin fastener 210 is installed on pole 105 and another on base system 103. First end 213 of shaft 211 is inserted into an aperture and nut 217 and washer 219 are used to secure pin fastener 210 by interference fit. Disk 221 and disk apertures 223 need to be oriented and aligned to permit use of disk pin 224. When both pin fasteners 210 are installed, pivot pole 105 around disk pin 224 so as to align the disk apertures 223 in corresponding pin fasteners 210. Insert disk pin 224 and hold in place with a retaining pin 225.

To lower lighting apparatus 107 to the ground, remove all disk pins 224 except for the lowest disk pin 224. Pivot pole 105 in a direction E so as to lower pole 105 and lighting apparatus 107 to surface 111. In this embodiment, depending on the general shape and span of pole 105 over hoop portion 73, a ladder may still be needed to access lighting apparatus 107 when lowered to surface 111. Pin fasteners 210 may be oriented and located on any portion of base system 103 to permit the rotation of pole 105 in any direction desired with respect to post 75, 85.

Figure 14:
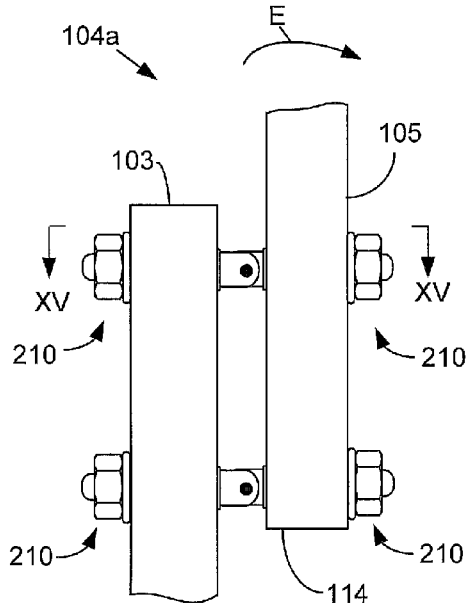
FIG. 14 is an enlarged side view of the fastening system of FIG. 2 using the pole fasteners of FIGS. 13A and 13B.
Figure 16:
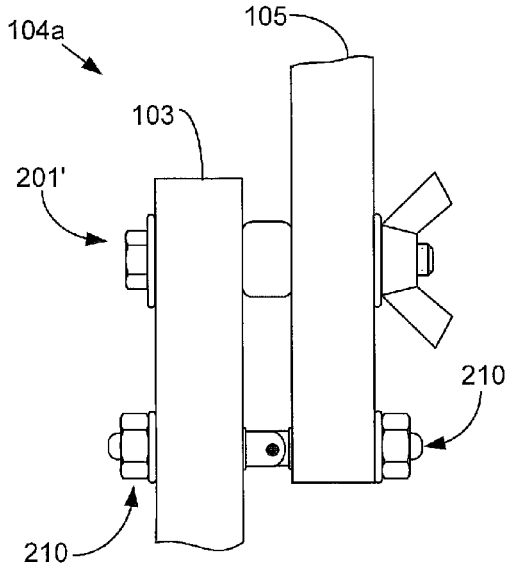
FIG. 16 is an enlarged side view of the fastening system of FIG. 2 using the pole fasteners of FIGS. 11, 13A, and 13B in conjunction.

Referring now also to FIG. 16, an enlarged side view of fastening system 104*a* using a variety of pole fasteners is illustrated. Pin fastener 210 and bolt fastener 201' is illustrated. Although pin fastener 210 and bolt fasteners 201 have been described as being used separately, it is understood that pin fasteners 210 and bolt fasteners 201 may be used together as seen in FIG. 16. Pin fastener 210 is located below bolt fastener 201' in this embodiment. This embodiment allows an extra degree of rotation as compared to that seen with using pin fasteners 210 or bolt fasteners 201 exclusively as seen in FIGS. 12, 14, and 15. This embodiment permits pole 105 to pivot away from base system 103 on disk pin 224 as denoted by direction E in FIG. 15 when bolt fastener 201 is removed. Furthermore, pole 105 may pivot in a direction D as seen in FIG. 15 wherein disk pin 224 is removed and wing nut 202 is loosened.

It is noted that bolt fastener 201' used in this embodiment is the same as bolt fastener 201 described above except that bolt fastener 201 uses a thicker bushing to permit a larger spacing between pole 105 and base member 103. It is understood that the placement of pole 105 as located on base system 103 is not critical. In other words, lighting system 102 may be positioned such that pole 105 is located on a side opposite or adjacent base system 103 as post 75. Furthermore, pole 105 may be located on base system 103 so as to permit pole 105 to pivot any direction with respect to post 75 by using any pole fasteners 113.

Figure 17:
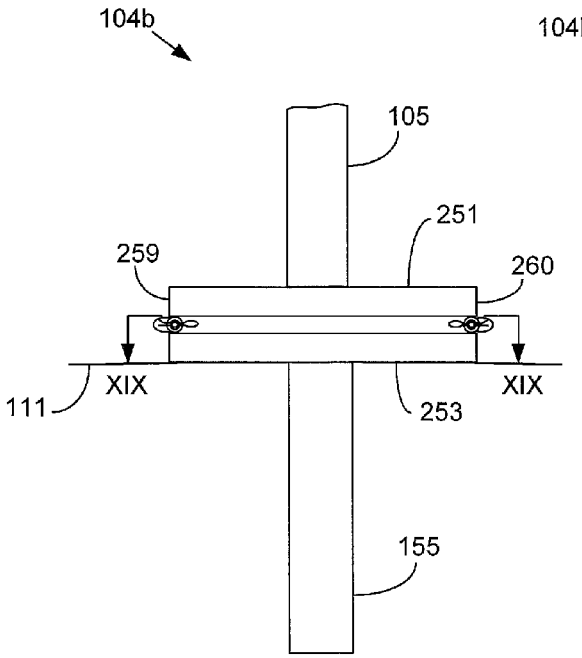
FIG. 17 is an enlarged side view of an alternate embodiment of the fastening system of FIG. 2.
Figure 18:
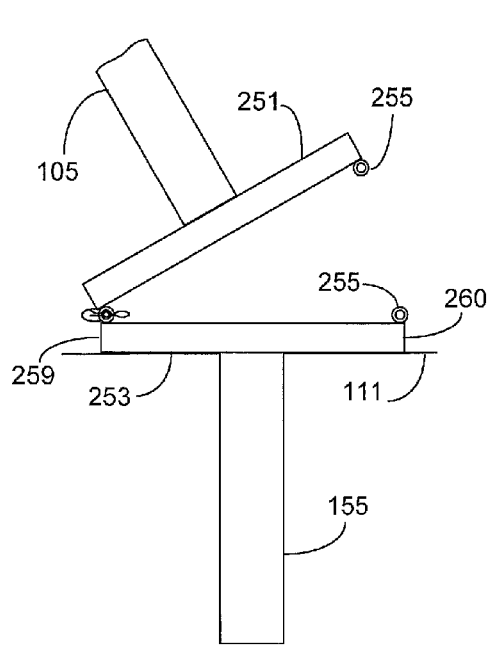
FIG. 18 is a side view of the fastening system of FIG. 17 pivoted around a hinge pin.
Figure 19:
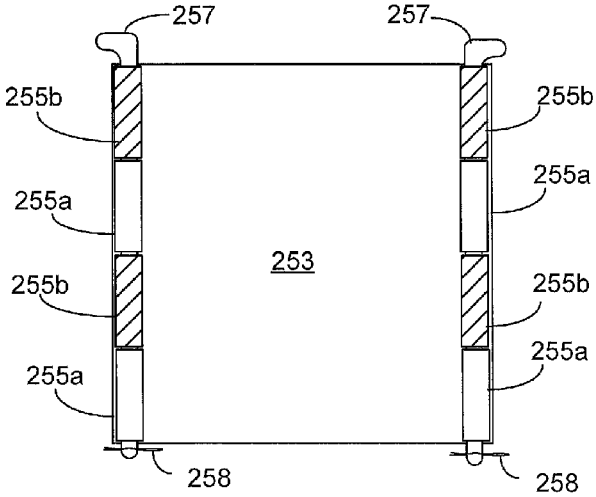
FIG. 19 is a top section view of the hinge plate of FIG. 17 taken at XIX-XIX.

Referring now also to FIGS. 17, 18, and 19 in the drawings, a fastening system 104*b* is illustrated. Fastening system 104*b* is an alternate embodiment of fastening system 104*a*. In fastening system 104*b*, hinge plates are used to pivot pole 105 to lower lighting apparatus 107 to surface 111. Fastening system 104*b* may be used on base system 103 and any of the alternate embodiments. For purposes herein, fastening system 104*b* will be depicted and described with base system 155. Fastening system 104*b* uses an upper hinge plate 251 and a lower hinge plate 253.

Upper hinge plate 251 is rigidly coupled or fastened to pole 105. Likewise, lower hinge plate 253 is coupled or fastened to base system 155. Each hinge plate 251, 253 has one or more pin slots 255*a*, 255*b* located along opposing sides of each hinge plate 251, 253 as seen in FIG. 19. Pin slot 255*a* is coupled to upper hinge plate 251 and pin slot 255*b* is coupled to lower hinge plate 253. Typically, each hinge plate would contain at least one pin slot 255*a*, 255*b* on each side 259, 260. Pin slots 255*a*, 255*b* are hollow to accept a hinge pin 257. Pin slots 255*a*, 255*b* are concentrically aligned with each other pin slot 255 located on the same side 259, 260 of hinge plates 251, 253.

For example, FIG. 19 shows a top section view of lower hinge plate 253. Pin slots 255*a*, 255*b* for each hinge plate 251, 253 are shown. Hinge pin 257 is inserted into pin slots 255*a* of upper hinge plate and 255*b* of lower hinge plate to secure upper hinge plate 251 and lower hinge plate 253 together, thereby preventing rotation of lighting system 102. One hinge pin 257 is required for each set of pin slots 255*a*, 255*b*. Hinge pin 257 can be any number of objects having a shaft, such as a pin or bolt, for example. A cotter pin 258 could be used to prevent accidental removal of pin 257.

When rotation is desired, one hinge pin 257 needs to be removed as seen in FIG. 18. Although described and depicted in a specified way above, it is understood that sizes and quantities of pin slots 255 may be altered. Furthermore, the arrangement of pin slots 255 may be any conceivable arrangement so as to permit rotation of lighting system 102. Similarly to that of fastening system 104*a*, fastening system 104*b* may be oriented in any way relative to post 75 to permit pivoting of pole 105. Additionally, hinge plates 251, 253 can be located at any height above surface 111 desired.

Figure 20:
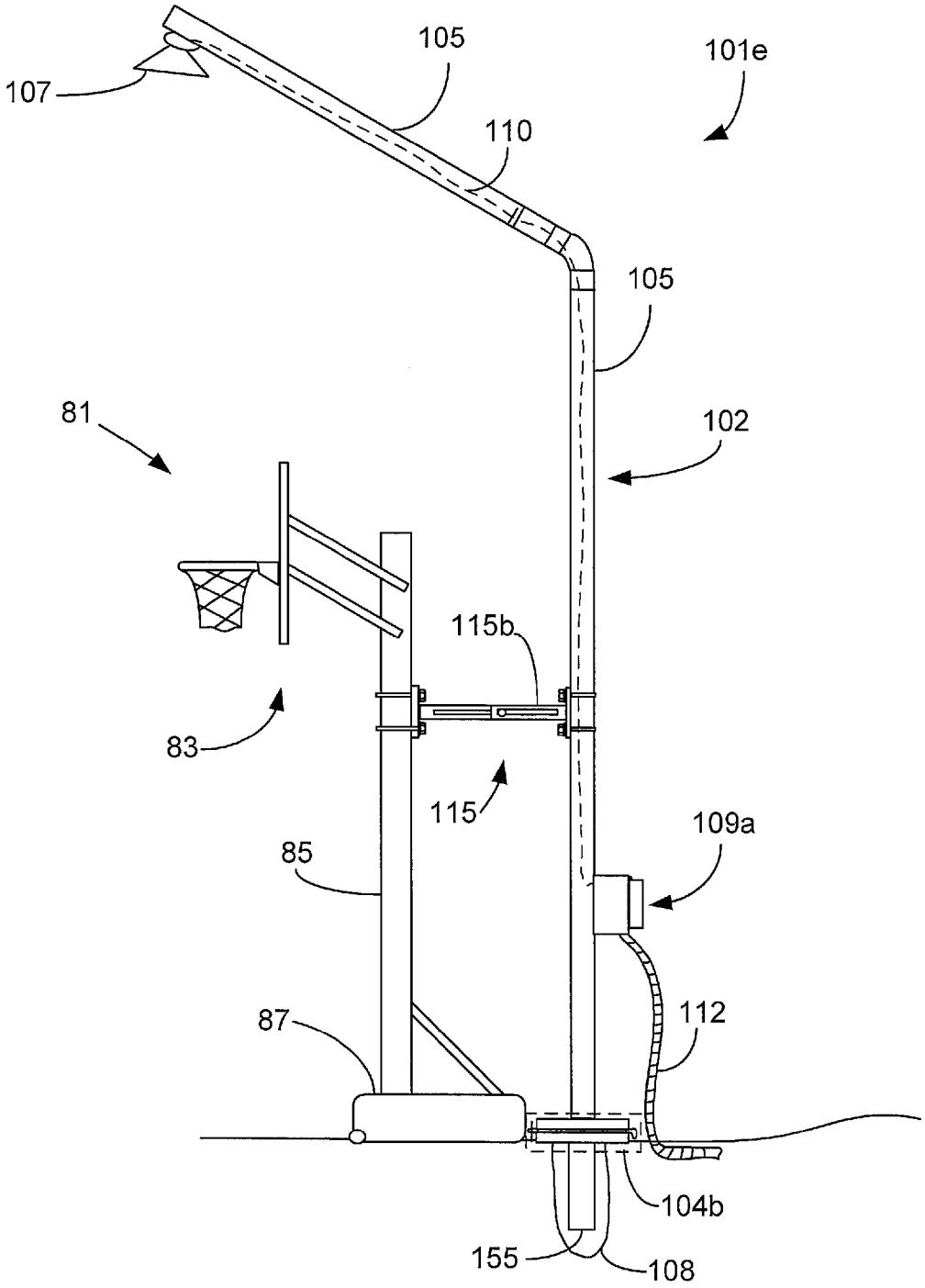
FIG. 20 is a side view of the lighted basketball system of FIG. 10 and the fastening system of FIG. 17.

Referring now also to FIG. 20 in the drawings, basketball system 101*e* incorporating fastening system 104*b* is illustrated. Basketball system 101*e* includes lighting system 102, fastening system 104*b*, power center 109*a*, and base system 103. It is understood that reference to base system 103 is to include all the alternate embodiments described above. Although depicted with basketball goal 81, it is understood that basketball system 101*e* may be used with basketball goal 71. In other words, fastening system 104*b* may be used in place of fastening system 104*a* in any of the previously described embodiments of basketball system 101*a*, 101*b*, 101*c*, 101*d*.

Figure 21:
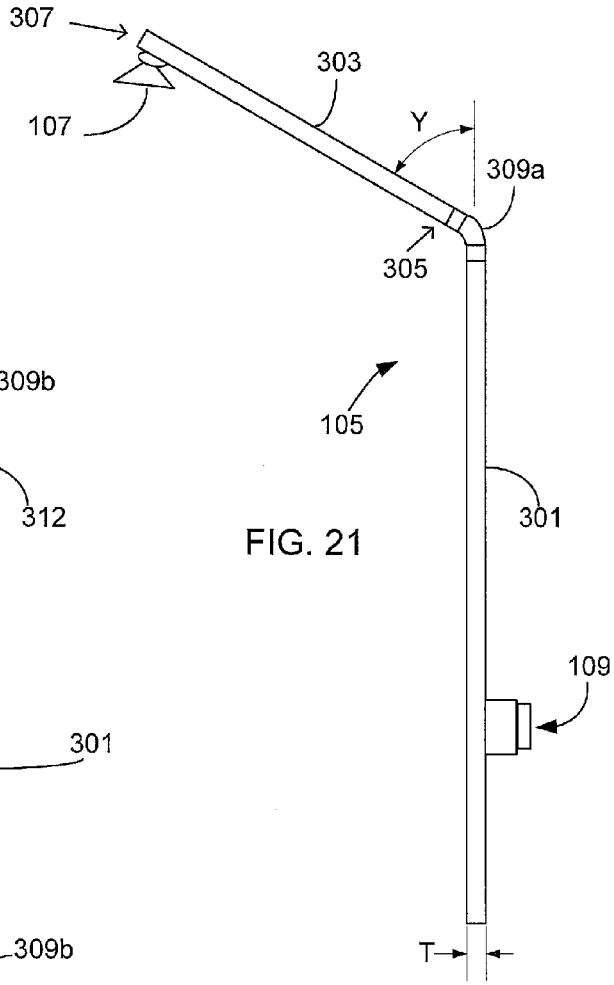
FIG. 21 is a side view of the lighting system of FIG. 2, wherein the lighting system has a joint.

Referring now also to FIG. 21 in the drawings, a side view of lighting system 102, according to the preferred embodiment, is illustrated. Pole 105 extends from base system 103 and over hoop portion 73 wherein lighting apparatus 107 is secured. Lighting apparatus 207 is located so as to front light the backboard of hoop portion 73, 83. Pole 105 has a vertical shaft 301 and an arm 303 that extends from vertical shaft 301 over hoop portion 73. Arm 303 has a first end 305 and a second end 307. First end 305 is coupled to vertical shaft 301, thereby creating a joint 309*a*, and second end 307 is located opposite first end 305 on arm 303. Lighting apparatus 107 is coupled to arm 303 near second end 307.

Pole 105 is composed of one or more pipes (not shown) swaged together in order to keep pipe lengths at a minimum for simplified transportation, packaging, and display in stores having limited display space. In the preferred embodiment, pole 105 is composed of hollow square pipes. It is understood that round cross sectional pipes may be used in other embodiments. Pole 105 has a width T. Width T may be any size. For example, width T may be 3 inches. Although the preferred embodiment swages pipes together, it is understood that other methods of coupling pipes end to end may be used, such as sleeves, brackets, or welding, for example. Furthermore, pole 105 may be composed of vertical shaft 301 and arm 303 wherein each is a single piece of pipe, or pole 105 can be composed of a single bent pipe comprising both vertical shaft 301 and arm 303.

Pole 105 may also include a joint 309*a* located where arm 303 and vertical shaft 301 join. In the preferred embodiment, joint 309*a* is not adjustable, thereby creating a fixed angle Y between arm 303 and vertical shaft 301. Joint 309*a* may be formed in many ways. For example, a fitting (not shown), such as an elbow fitting may be used to couple vertical shaft 301 and first end 305. Furthermore, joint 309*a* may consist of a pipe, similar to arm 303 and vertical shaft 301, bent to angle Y wherein the pipe couples to arm 303 and vertical shaft 301. Other embodiments are possible for creating joint 309*a* permitting arm 303 to extend over backboard 53.

Figure 22:
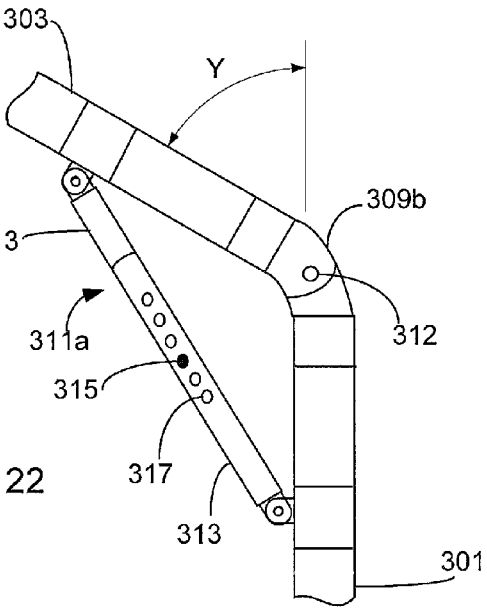
FIG. 22 is an enlarged side view of an alternate embodiment of the joint of FIG. 21.
Figure 23:
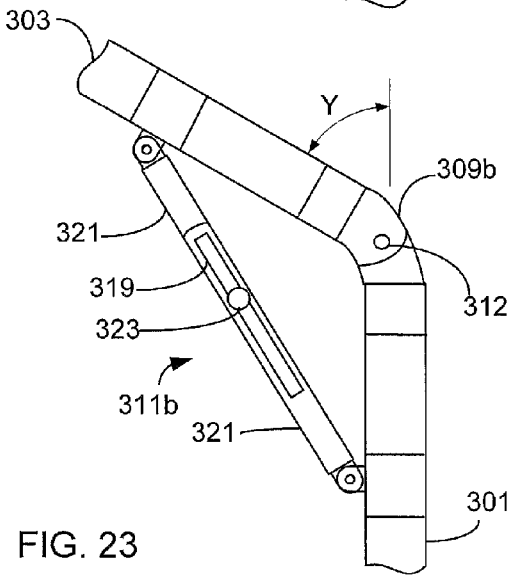
FIG. 23 is an enlarged side view of an alternate embodiment of an adjustable joint of FIG. 22.

Referring now also to FIGS. 22 and 23 in the drawings, an enlarged side view of lighting system 102 having an adjustable joint 309*b* is illustrated. Arm 303 and vertical shaft 301 are coupled using an adjustable joint 309*b*. In other embodiments, joint 309*b* may be used to allow arm 303 to move up to angle Y as measured from the axis of vertical shaft 301. Angle Y can be any angle desired, such as zero, therein permitting arm 303 to extend upward, such that arm 303 and vertical shaft 301 are parallel. This position is useful for sports or activities such as volleyball where objects such as balls are at more risk of striking lighting apparatus 107. The ability to adjust angle Y also permits lighting system 102 to be used in/for other sports and/or activities. Furthermore, angle Y may be large enough to permit arm 303 to be relatively horizontal. Although selected values for angle Y have been described, angle Y is not limited to the range of values depicted or described. Such examples described and depicted serve as examples only.

Adjustable joint 309*b* permits rotation of arm 303 along the plane created by arm 303 and vertical shaft 301. Adjustable joint 309*b* is typically hinged by use of a joint pin 312, such as a pin or bolt, for example. A further example of adjustable joint 309*b* is a tongue and clevis joint wherein either arm 303 or vertical shaft 301 contains the clevis. Other embodiments of adjustable joint 309*b* that permit arm 303 to rotate are understood to be possible. For example, adjustable joint 309*b* may permit arm 303 to swivel on vertical shaft 301 thereby permitting arm 303 to rotate up to 360 degrees around vertical shaft 301.

A joint support system is used to stabilize and retain the desired angle Y when adjustable joint 309*b* is used. Joint support system 311*a* is operably coupled to arm 303 and vertical shaft 301. Joint support system 311*a* has the ability to adjust to a multitude of lengths to permit a desired range of motion for arm 303. Joint support 311*a* may contain two concentric shafts 313 mated within one another wherein a pin 315 is inserted into a pin hole 317 thereby securing arm 303 at a set angle Y. In another embodiment, joint support system 311*b* may use slots 319 in adjacent beams 321 wherein a bolt 323 is used to secure, by interference fit, arm 303 at a desired angle Y.

Figure 24:
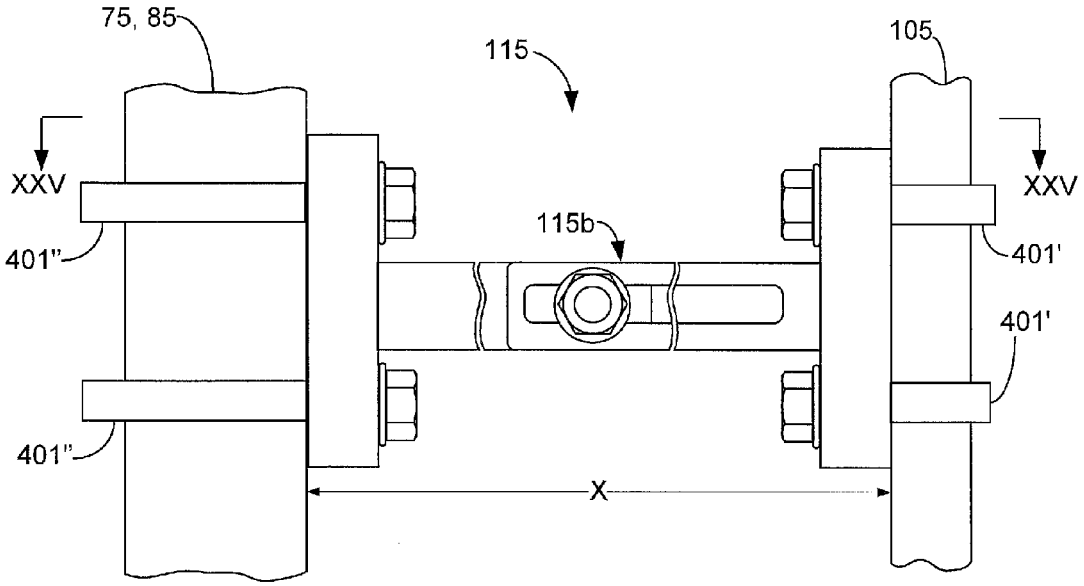
FIG. 24 is an enlarged side view of an alternate embodiment of a support of FIG. 2.
Figure 25:
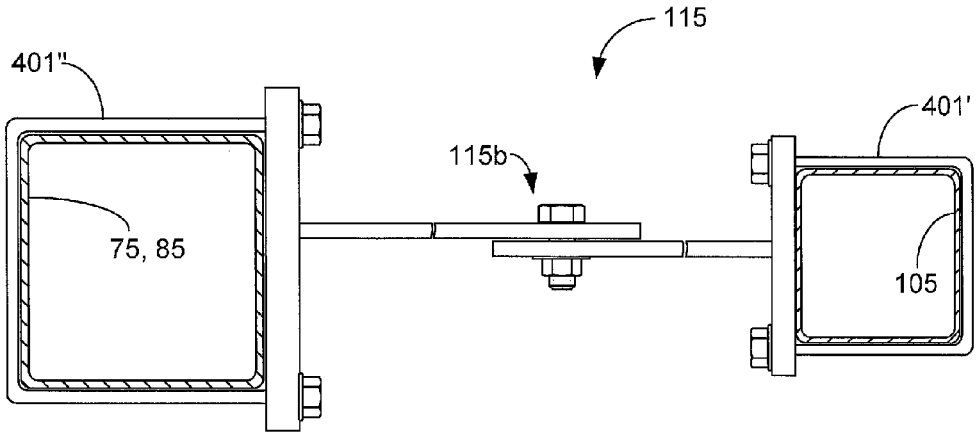
FIG. 25 is an enlarged top section view of the support of FIG. 24 taken at XXV-XXV.

Referring now also to FIGS. 24 and 25 in the drawings, wherein support system 115 used between pole 105 and post 85 is illustrated. Support system 115 helps to restrict movement of pole 105. Support system 115 includes a non-adjustable support 115*a* or an adjustable support 115*b*. In the preferred embodiment, support 115*a* is rigid and non-adjustable as shown in FIG. 2. In the preferred embodiment and additional embodiments as described in FIGS. 2-9, base system 103 is a rigid piece of material having a predetermined length. The predetermined length of base system 103 allows for a predetermined distance X to exist between pole 105 and post 75. Because distance X is known, support system 115 would typically use support 115*a* as seen in FIG. 2.

In embodiments where distance X is not known before installation of pole 105, such as seen in FIGS. 10 and 20 where the location of base system 155 is unknown, support system 115 may use support 115*b*, wherein support 115*b* is configured to be adjustable. Support 115*b* may be formed or shaped in a multitude of ways such as those described with respect to joint support system 311*b* above. FIGS. 22 and 23 illustrate support 115*b* as seen in FIGS. 10 and 20.

Support system 115 typically further includes a U-bolt 401' to couple support 115*a*, 115*b* to pole 105 and a U-bolt 401" to couple support 115*a*, 115*b* to post 85. Other methods of securing support 115*a*, 115*b* are possible, such as welding, U-brackets, or through-drilling in pole 105 and/or post 75, 85 for use of bolts, to name a few. An advantage of U-bolts 401', 401" is the ability to remove and attach support system 115 without modifying post 75, 85 or pole 105. Although use of support system 115 has been described, it is understood that in the preferred embodiment use of support system 115 is optional. An advantage of the preferred embodiment is that pole 105 and basketball goal 71, 81 are either coupled together at the base of post 75, 85 or remain unconnected by using base system 155. This feature allows lighting system 102 to remain relatively free from vibrations and shaking of basketball goal 71, 81. Lighting apparatus 107 is therefore less susceptible to damage or premature wear.

Figure 26:
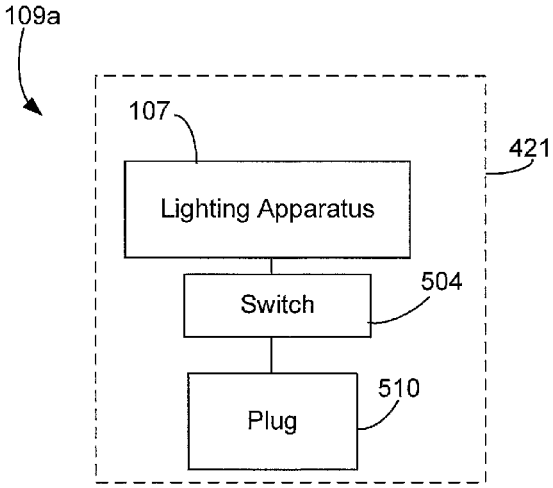
FIG. 26 is a schematic of a power center of FIG. 2.

Referring now also to FIG. 26 in the drawings, wherein power center 109*a* is illustrated. Lighting system 102 includes a lighting apparatus 107 coupled to arm 303. Lighting apparatus 107 is wired to receive electricity from a power source. Wiring 110 for lighting apparatus 107 is channeled within pole 105 until the wiring reaches power center 109*a* coupled to pole 105. This allows the wiring 110 to remain protected from the elements and possible damage from external objects.

In the preferred embodiment, power center 109*a* is a junction box 421 having a plug 510, such as a resist motor base plug (not shown). A resist motor base plug permits the wiring to be connected to a male plug located inside junction box 421 so that power can be received by a conventional extension cord having a female end. Power may be provided to lighting apparatus 107 by plugging in an extension cord from a house for example. Lighting apparatus 107 is positioned to shine light around basketball goal 71, 81 when lighting apparatus 107 is provided electrical power. When lighting apparatus 107 is to be turned off, the extension cord needs only to be unplugged. However, an extension cord may be left plugged in to power center 109*a*, wherein power center 109*a* includes a switch 504 for turning on or off lighting apparatus 107. Although described as having power center 109*a* coupled to pole 105, it is understood that power center 109*a* may be located and/or coupled to any portion of basketball system 101*a*, 101*b*, 101*c*, 101*d*, 101*e*. The features and limitations of power center 109*a* in relation to basketball system 101*a*, 101*b*, 101*c*, 101*d*, 101*e* are similar. Therefore for reference to basketball system 101*a* will hereinafter refer to all embodiments of basketball system 101*a*.

Figure 27:
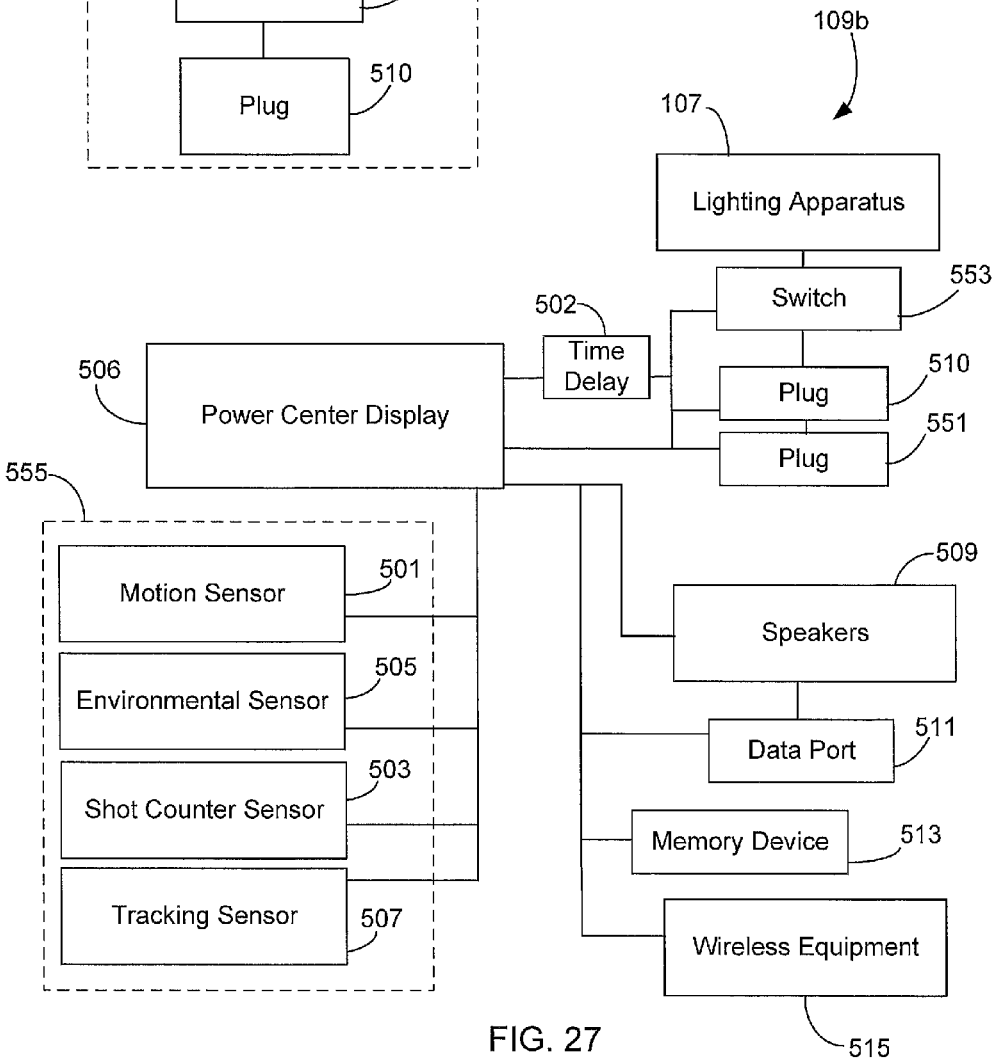
FIG. 27 is a schematic of an alternate embodiment of the power center of FIG. 26.

Referring now also to FIG. 27, another embodiment of power center 109*a* is illustrated. Power center 109*b* is similar in form and function to that of power center 109*a* except as noted herein. Power center 109*b* is operably connected to lighting apparatus 107 through wires 110 like unto power center 109*a*. Furthermore, power center 109*b* has a plug 551 and a switch 553. Plug 551 is a conventional plug to allow a user to receive power from power center 109*b* to operate various electronic devices. Plug 551 may also be plug 510 as described with power center 109*a*. It is understood that any number of plugs 551, 510 may be used. Furthermore, power center 109*b* can contain a time delay function 502 that will automatically turn on and off lighting apparatus 107. It is understood that switch 553 may be operably connected to any number of plugs 510 to turn power on or off to the plug 510.

Power center 109*b* is a fully integrated functional digital display 506, such as a touch screen, providing a user with the ability to monitor and control basketball system 101*a*, download or upload electronic data, and even wirelessly connect to the internet. Power center 109*b* is preferably hard wired directly to a power source, such as a home, so as to receive a constant power supply. Wiring for power center 109*b* could be provided through a flexible electrical conduit 112. Conduit 112 would be configured to permit pivoting of pole 105. However, it is understood that temporary power through means of extension cords or batteries, for example, may also be used. Likewise, power center 109*b* may be configured to receive power through plug 510.

Power center 109*b* can include a sensor 555, a memory device 513, and/or a data port 511. Power center 109*b* can operate so as to have any number of sensors 555 for gathering external data and communicating that data electronically to power center 109*b*. Sensors 555 can communicate through wires or wirelessly with display 506. For example, power center 109*b* may contain a motion sensor 501 positioned on basketball system 101*a* to detect when a player enters the court. Motion sensor 501 operates to turn on lighting apparatus 107 when motion is detected. Additionally, power center 109*b* may contain a shot counter sensor 503 located preferably near the rim. Shot counter sensor 503 detects when an object passes through the rim thereby tracking the number of shots made. Shot counter sensor 503 can also be programmed to detect selected levels of vibrations on hoop portion 73, 83 to signal that a shot has been attempted. Power center 109*b* may also have an optical tracking sensor 507 to track the location of the players on the court. Tracking sensor 507 is preferably located near lighting apparatus 107. This location allows tracking sensor a clear line of sight to most of the playing surface. Tracking sensor 507 permits power center 109*b* to detect the location of the shooter (not shown) on the court when a shot is attempted. Furthermore, environmental sensors 505 may be used to track external conditions such as weather conditions for example. Power center 109*b* compiles the electronic data from tracking sensor 507 and shot counter sensor 503 to produce statistical information such as shooting percentage, for example.

In addition, it is understood that power center 109*b* may include speakers 509 incorporated into power center 109*b*. Data port 511 is integrated directly into power center 109*b*. Data port 511 can be a docking station, USB, or auxiliary jack, to name a few to permit the transfer of electronic information. Data ports 511 permit electronic data to be downloaded or uploaded from digital recording or storage devices and cellular devices, to name a few. Data ports 511 are also configured to accept inputs from external equipment such as additional speakers 509, electronic equipment, and digital devices, to name a few.

For example, a user could operably connect an electronic music playing device to power center 109*b* through data port 511 and audibly play recorded information from speakers 509. Additionally, power center 109*b* may play such recorded information through external speakers operably connected through data ports 511 as well. Furthermore, power center 109*b* may audibly count the number of made baskets to the shooter through speakers 509. The audible function aids the shooter in keeping track of the number of shots made. Power center 109*b* may have one or more data ports 511.

In like manner, power center 109*b* may also include memory device 513, such as a hard drive or flash memory, to permit for the storage of electronic data, such as songs, compiled data from basketball system 101*a*, sensors 555, or viewable data files like pictures or video, for example. After a practice shooting session is completed, a player is able to download from data port 511 the statistics of the session to a computerized device.

Although power center 109*b* has been described as being hard wired to a power source, it is understood that power center 109*b* may also be solar powered so as to be relatively independent of the need for wiring or batteries. The addition of power center 109*b* gives the advantages of easy maintenance and the convenience of operating lighting system 102. It is recognized that the addition of a power source provides almost unlimited possibilities regarding features and uses with basketball system 101*a*. Other features are understood to be possible. Furthermore, power center 109*b* may be located remote to any portion of basketball system 101*a*, merely being operably connected through wires or wireless equipment 515.

Figure 28:
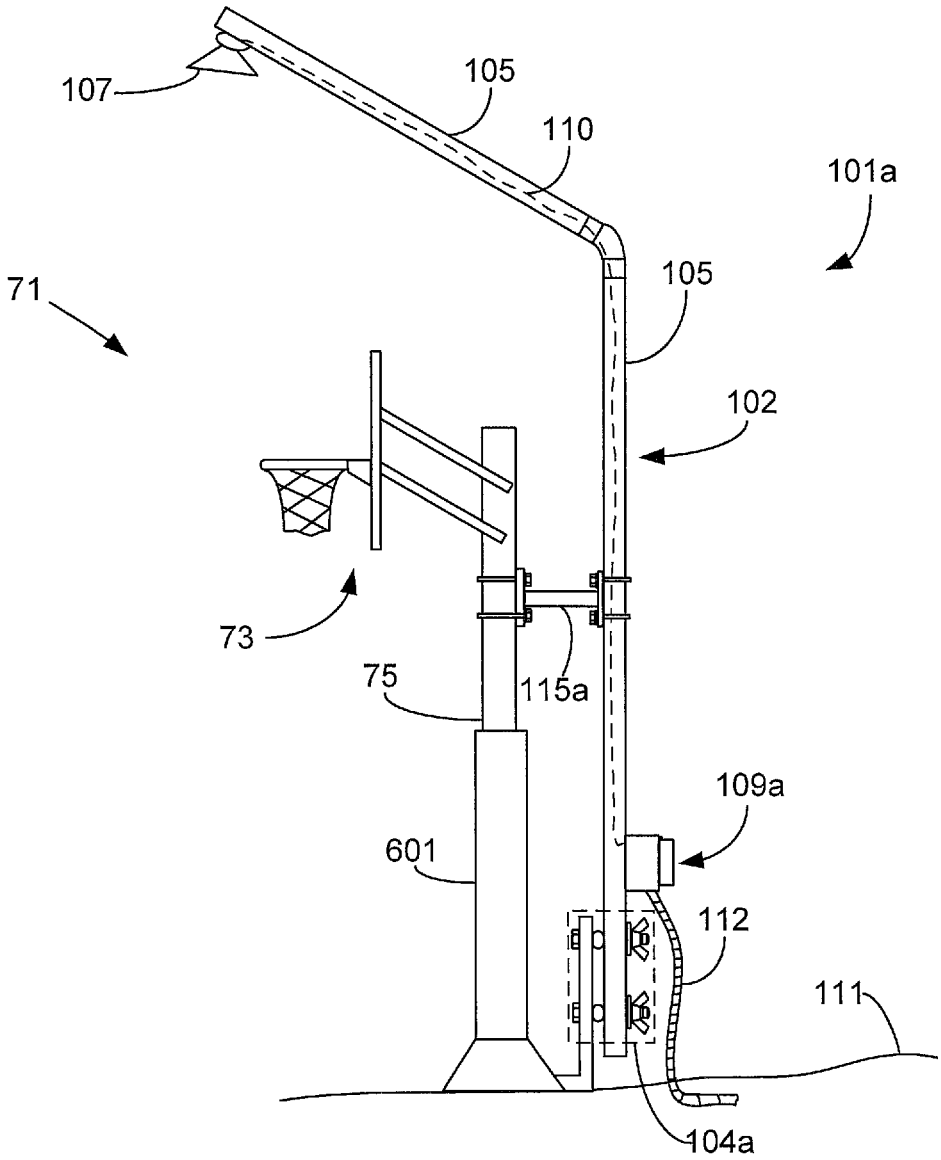
FIG. 28 is a side view of the lighted basketball system of FIG. 2 with safety pads.

Referring now also to FIG. 28, basketball system 101*a* having a safety pad 601 is illustrated. As a safety feature, basketball system 101*a* may include safety pad 601 generally consisting of energy absorbing material. Safety pad 601 is configured to protect users from contact with basketball system 101*a*. Safety pad 601 may be located in other areas and cover any portion of basketball system 101*a*.

The method of installing lighting system 102 has been greatly simplified. A user secures base system 103. Next the pipes are swaged together to create pole 105 having joint 309*a* or joint 309*b*. If joint 309*b* is used, joint support system 311*a*, 311*b* would be installed. Lighting apparatus 107 is coupled to arm 303 wherein the wiring is run along the inside of pole 105. Fastening system 104*a*, 104*b* is used to secure pole 105 to base system 103 as described above. Power center 109*b* is operably connected to basketball goal 71, 81 and/or lighting system 102. The method of lowering and raising pole 105 can be repeated at any time in order to allow for servicing of lighting apparatus 107 or to adjust joint support system 311*a*, 311*b*. If support 115 is used, support 115 would need to be removed or added while pole 105 is in a relatively upright or vertical position.

The current application has many advantages over the prior art including the following: (1) Avoiding vibration transmitted to lighting apparatus 107 by the shaking of basketball goal 71, 81; (2) ability to access lighting apparatus 107 at ground level for servicing; (3) ability to lower lighting apparatus 107 completely to the ground; (4) positioning of lighting apparatus above hoop portion 73, 83 so as to avoid blinding the eyes of the shooter; (5) ease of installation by allowing for the assembly of lighting system 102 at ground level without the use of a ladder; and (6) manufactured for ease of shipping by swaging pole 105 together; (7) the ability to install lighting system 102 to existing basketball goals without the need to use a ladder or remove existing plate fasteners 123; (8) the ability to rotate lighting apparatus to different positions such that lighting apparatus 107 can be used for various sports or activities.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A lighting assembly for a basketball goal having a base plate and a post, the lighting system comprising:

a pole extending over the basketball goal being separate from the post holding the basketball goal;

a lighting apparatus coupled to the pole;

a base system for supporting the pole, the base system being separate from the post and coupling to the base plate adjacent the ground; and a fastening system for securing the pole to the base system, the fastening system configured to allow the pole to selectively pivot adjacent ground level in one or more directions relative to the base system; such that the lighting apparatus can be lowered near to the ground level on either side of the basketball goal.

2. The lighting assembly of claim 1, wherein the pole includes a predetermined angle between a generally vertical shaft and an arm that extends out over the basketball goal.

3. The lighting assembly of claim 2, wherein the predetermined angle is formed by an adjustable joint.

4. The lighting assembly of claim 1, wherein the adjustable joint is supported by a joint support system, the joint support system being configured to allow the predetermined angle to vary.

5. The lighting assembly of claim 1, wherein the base system is removably coupled to the base plate via existing base fasteners.

6. The lighting assembly of claim 1, wherein the base system is coupled to the base plate with a base system fastener, the base system having a bore and an aperture configured to accept and surround existing base fasteners, such that the basketball goal remains secured to the surface during installation and removal of the base system.

7. The lighting assembly of claim 1, wherein the base system is remote from the base plate and is secured directly to the ground.

8. The lighting assembly of claim 1, wherein the fastening system comprises:

one or more quick-release pole fasteners.

9. The lighting assembly of claim 1, wherein the fastening system has a hinge plate and a hinge pin.

10. The lighting assembly of claim 1, wherein the pole is formed of one or more pipes swaged together.

11. The lighting assembly of claim 1, further comprising:

an electrical power center for providing electrical power to the lighting apparatus, the power center being configured to receive electrical power within a junction box from a power source, the junction box having any number of plugs and switches for providing power to the lighting apparatus and other electrical devices.

12. A basketball system, comprising:

a basketball goal having a post and a backboard;

a base system rigidly coupled to a bottom portion of the post adjacent the ground for supporting the basketball goal;

a lighting system having a pole and a lighting apparatus, the lighting apparatus being positioned to front light the backboard; and a fastening system for pivotally coupling the lighting system to the base system, such that the lighting apparatus can be lowered adjacent to the ground by pivoting to either side of the basketball goal.

13. The basketball system of claim 12, wherein the fastening system has at least one pole fastener sized and configured to allow quick-release of the pole fastener without the use of a tool.

14. The basketball system of claim 12, wherein the pole is formed from one or more pipes, the pipes configured to swaged together.

15. The basketball system of claim 12, wherein the pole has a generally vertical shaft and an arm rotatably coupled to the vertical shaft thereby forming an angle, the angle configured to vary as desired.

16. The basketball system of claim 12, further comprising:

a safety pad disposed at least partially about the post.

17. The basketball system of claim 12, further comprising:

a support system for stabilizing the lighting system relative to the post, the support system being releasably coupled between the pole and the post.

18. A method of installing a lighting system for a sporting system having at least one post, comprising:

securing a base system, the base system used to support the orientation of the post and the lighting system, the base system being adjacent the ground;

attaching a lighting apparatus to a pole, the lighting apparatus and the pole forming a lighting system;

pivotally coupling the pole to the base system via a fastening system;

pivoting the pole about the fastening system, so as to raise the lighting system to a desired position, the pole pivoting the lighting apparatus to either side of the post so as to lower the lighting apparatus to the ground;

securing the pole to the base system with the fastening system.

19. The method of installing a lighting system according to claim 18, further comprising:

coupling a support system between the pole and a post on a basketball goal.

20. The method of installing a lighting system according to claim 18, further comprising:

servicing the lighting system by pivoting the pole via the fastening system, so as to lower the lighting apparatus near to a surface, the lighting system configured to be serviced without the need for a ladder.

* * * * *